United States Patent [19]

Rosenquist

[11] 4,023,609

[45] May 17, 1977

[54] DRAPERY TRACK

[75] Inventor: Kurt E. Rosenquist, Pacific Palisades, Calif.

[73] Assignee: Louver Drape, Inc., Santa Monica, Calif.

[22] Filed: June 3, 1975

[21] Appl. No.: 583,279

[52] U.S. Cl. ..... 160/343
[51] Int. Cl.² ..... A47H 5/06
[58] Field of Search ..... 160/343, 330, 188, 126; 16/87, 87.2, 87.4, 87.6, 87.8; 49/362

[56] References Cited

UNITED STATES PATENTS

| | | | |
|---|---|---|---|
| 2,801,690 | 8/1957 | Bennett | 160/343 |
| 2,883,182 | 4/1959 | Bornemann | 160/188 UX |
| 3,003,552 | 10/1961 | Eilenberger | 160/343 X |
| 3,198,243 | 8/1965 | Ford | 16/87.4 R X |
| 3,774,665 | 11/1973 | Bourne | 160/343 |

*Primary Examiner*—Philip C. Kannan
*Attorney, Agent, or Firm*—Lyon & Lyon

[57] ABSTRACT

A drapery track having a rod contained within a channel member, the rod being provided with a spiral thread or threads. A resilient flexible sleeve is positioned about the rod. Rotation of the rod by an operating means drives a carriage, which in turn drives a plurality of truck means along the rod.

7 Claims, 3 Drawing Figures

DRAPERY TRACK

BACKGROUND OF THE INVENTION

1. Field of the Invention

The invention relates to a drapery track. More particularly, it relates to an improved drapery track utilizing a "threaded" rod drive means.

2. Brief Description of the Prior Art

Typically, moveable draperies utilize what is referred to in the industry as a "cord track". Such a track allows for the opening and closing of the drapery by means of a cord. One or more pulleys may be utilized with the cord in order to change direction of the force produced by pulling the cord which is attached to a carriage means. The carriage means is caused to traverse along the track support by pulling one or more cords. The carriage means in turn forces a plurality of truck means along the track support, the carriage and the truck means generally being provided with a series of holes into which hooks or pins attached to drapery material may be attached. Such "cord tracks" exhibit several disadvantages. The cords are lengthy, and if allowed to extend below the length of the drape produce a rather unsightly visual effect. The cords may become tangled rendering the drapery track inoperable. Likewise the drapery track operation may be impeded or interrupted by pulling the cord over a sharp or abrasive track surface thus producing fraying and eventual severance of the cord.

Rods providing a spiral threaded drive have been successfully employed in the vertical blind field, thereby allowing for the replacement of the cord and its related mechanism. However, a rod having such a drive means has not been successfully employed in a drapery track. The reason for this inability may be described as follows. The drapery rod if supported only at the rod ends, as is generally the case, deflects due to its weight. Assuming the rod to perform as a simple, uniformly loaded beam, the maximum deflection occurs at the midpoint of the rod, its magnitude being determinable from the following equation:

$$\delta \text{ max.} = \frac{5\ wl^4}{384\ EI}$$

where $w$ is the weight of the rod, l is the rod length, E is the modulus of elasticity for the rod and I is the moment of inertia of the rod. (See generally Timoshenko *Elements of Strength of Materials*, D. Van Nostrand, pp. 197–230 (4th ed. 1962).) It can be seen from the foregoing equation that a change in length produces a corresponding fourth power change in the deflection, i.e. doubling the length of the drapery rod increases the deflection by a factor of 16. As it is often desirable to provide for drapery tracks of great length, such deflections may create substantial problems. When such a rod is rotated within a channel support member, the deflection or "bow" in the rod causes the rod to strike the channel producing unacceptable noise and clatter. Rod supports have been utilized in vertical blinds. However, such supports themselves produce objectionable noise. Moreover, such supports if employed in a drapery track would inhibit the traverse of a carriage drive member which is traversed along the rod when the drapery is opened and closed. Additionally, rods have not been successfully employed in drapery tracks as the drive of such rods may become obstructed by foreign material which may become lodged between the spiral threads. (See generally, Shigley, *Theory of Machines*, Helical, Worm and Bevel Gears, McGraw Hill pp. 179–206 (1961).

It is an object of this invention to provide an improved rod drapery track. Other and additional objectives will become apparent upon a reading of the entire specification, drawings and claims.

SUMMARY OF THE INVENTION

A drapery track having a rod contained within a channel member, the rod being provided with a spiral thread or threads. Rotation of the rod by an operating means drives a drive member and in turn a drapery track carriage, the drive member engaging the threads of the rod. The drapery track carriage in turn drives a plurality of truck means along the rod. A resilient flexible sleeve is positioned about the rod. Such a flexible sleeve prevents the rod from striking the channel as the rod is rotated, thus allowing for a more quiet and improved operation of the drapery rod. Additionally, the sleeve provides support for the rod. While sealing about the rod, thus precluding foreign particles from fouling the thread or threads, the sleeve is sufficiently flexible to allow for the carriage drive member to traverse the rod length, the sleeve at a given point along the rod being forced open by the traverse of the drive member, and the sleeve returning to its sealing position about the rod after the drive member has passed that particular point.

DESCRIPTION OF PREFERRED EMBODIMENTS

Figures 1, 2, 3, 4:
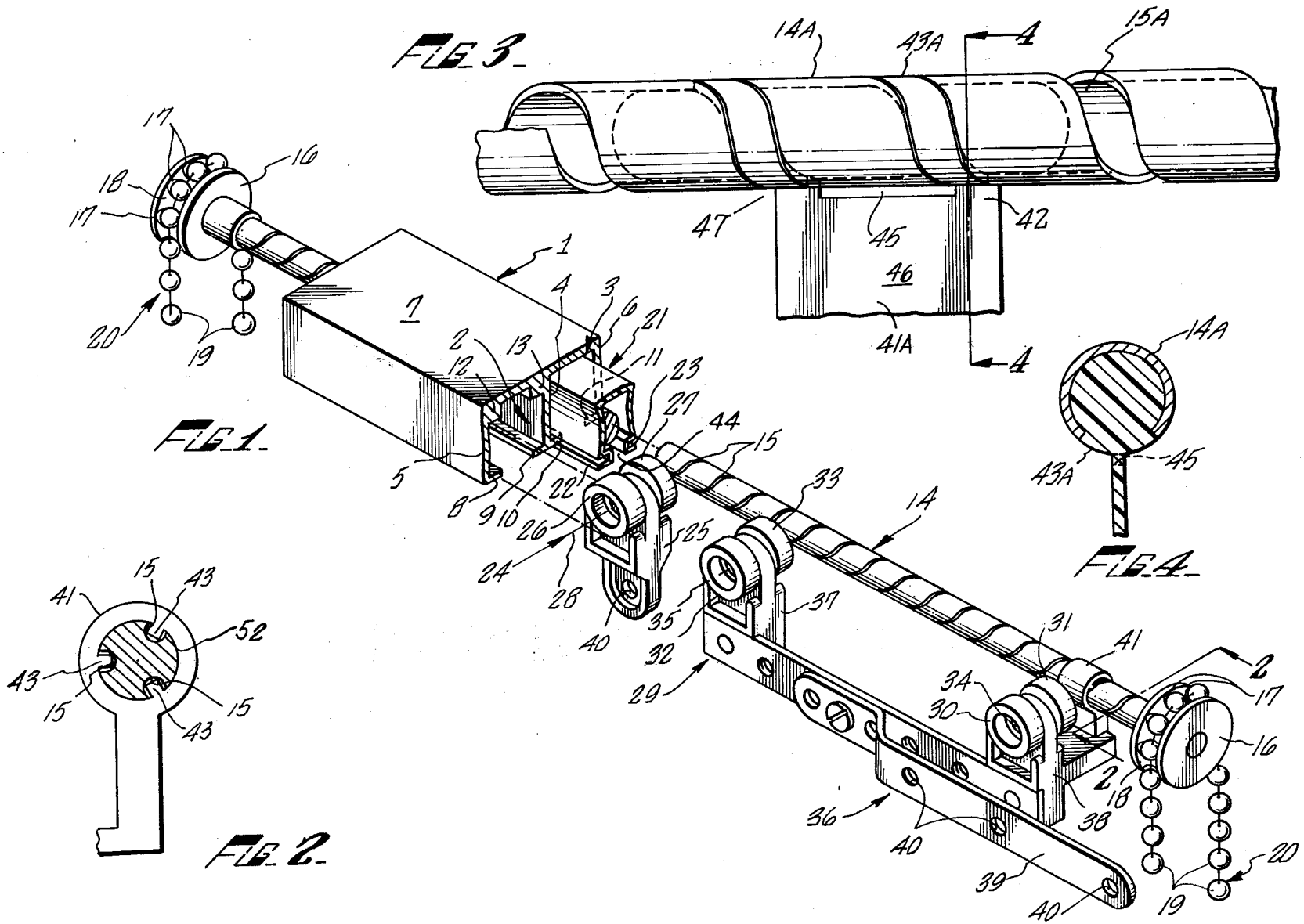
FIG. 1 is a partially sectioned perspective view of the drapery track of this invention.
FIG. 2 is a cross-sectional view taken along line 2—2 of FIG. 1.
FIG. 3 is a partial view of a rod of the drapery track of this invention.
FIG. 4 is a sectional view of a drive member engaging a rod of the type shown in FIG. 3.

Referring now to FIG. 1, a channel member 1 is depicted, the channel member 1 being adaptable for mounting to a window frame or the like (not shown). The channel member 1 may be provided with a first channel 2 and a second channel 3. The channels 2 and 3 may be parallel to each other and have a common inner wall member 4 which separates the first channel 2 from the second channel 3. The first channel 2 has an outer wall member 5, and the second channel 3 has an outer wall member 6, outer walls 5 and 6 being substantially parallel to the inner wall member 4 and substantially perpendicular to a channel base 7. The first channel 2 is further provided with inwardly extending lip portions 8 and 9 which are generally perpendicular to the inner wall member 4 and the outer wall member 5. In a preferred embodiment, the first channel 2 is further provided with raised portions 12 and 13 extending along the length of the channel member 1, the height of the raised portions 12 and 13 being such as to provide a predetermined distance between the lip portions 8 and 9 of the first channel 2 and the raised portions 12 and 13. The purpose of producing such a predetermined distance will be described subsequently in greater detail.

A rod 14 may be inserted in the second channel 3. FIG. 1 shows the rod 14 to be provided with a spiral thread or threads 15 on the exterior surface of the rod 14. FIG. 3 shows a hollow rod 14A which is provided with a spiral slot 15A cut longitudinally through the surface of the hollow rod 14A. The rod 14, or 14A as shown in FIG. 3, may be provided with a sprocket wheel 16 coupled to each end of the rod. As shown in FIG. 1, the sprocket wheels 16 may be provided with a plurality of spaced ribs 17 located about the periphery 18 of the sprocket wheel 16, the ribs 17 being adapted for the engagement of balls 19 of a ball chain 20. The sprocket wheels 16 and the rod 14 to which they are coupled may be rotated by pulling the ball chain at either end of the rod 14.

A resilient sleeve 21 may be positioned about the rod 14, thus effectively isolating the rod 14 from the second channel 3 within which the rod 14 is positioned and allowed to rotate. In a preferred embodiment, the sleeve 21 seals the rod 14 about the entirety of the rod's exterior surface, and the sleeve 21 may be provided with lip portions 22 and 23 which seal the sleeve 21 about the lip portions 10 and 11 of the second channel 3, a seam 44 being formed by the juncture of the lip portions 22 and 23 of the sleeve 21. The importance of the resiliency of the restraining sleeve will be described subsequently.

A plurality of truck means 24 may be positioned within the first channel 2. The truck means 24 are generally made up of a central truck member 25, and a pair of wheels or rollers 26 and 27. The rollers 26 and 27 may rotate about the same shaft 28. The central truck member 25 may be positioned between the rollers 26 and 27 and pivotally mounted about the shaft 28. The central truck member 25 may be further provided with one or more holes 40 within which pins or hooks, supporting a drapery material (not shown) may be inserted. In a preferred embodiment the outer diameter of the rollers 26 and 27 is slightly less than the predetermined distance between the lip portion 8 and the raised portion 12 and the lip portion 9 and raised portion 13 of the channel 2. Such a configuration allows the truck means 24 to be rolled quietly and efficiently along the length of the channel means 1.

A carriage 29 may also be provided with at least one pair of wheels or rollers 30 and 31. In a preferred embodiment a second pair of carriage rollers 32 and 33 are also provided. Wheels 30 and 31 may have the same shaft 34 about which they rotate. Similarly a pair of wheels 32 and 33 may have the same shaft 35 about which they rotate. The carriage body 36 has a first member 37 suspended from the shaft 35 and a second member 38 suspended from the shaft 34. A bracket means 39 joins carriage members 37 and 38, the bracket member 39 being provided with a plurality of holes 40 within which pins or hooks supporting a drapery material (not shown) may be inserted. The second carriage member 38 may be further provided with a carriage drive member 41 having an inner surface 42 which extends annularly around a portion of the rod 14. The carriage drive member 41 is provided with a spiral grooved surface 43 which engages the spiral thread of the rod 14 such that the spiral thread or threads 15 are engaged by the spiral grooved surface 43 of the carriage drive member 41, whereby the rotation of the rod 14 drives the drive member 41 and the carriage 29.

In another embodiment, a hollow rod 14A as shown in FIG. 3 is provided with a spiral slot 15A. The carriage drive member 41A has a spiral surface or land 43A at its upper portion 47 which engages the spiral slot 15A of the rod 14A as shown in FIG. 3. Connective members 52 extend from the upper portion 47 to a main portion 46 of the carriage drive member 41A. An opening 45 is provided between the connective members 42 whereby allowing for the rotation of the rod 14A. Alternately and included within the scope of this invention, the spiral slot 15A may be machined on the internal surface of the hollow rod 14A and a spiral opening provided in the rod 14A in order for the carriage member 41A to traverse the rod 14A.

In a preferred embodiment, the previously described sleeve 21 is sufficiently flexible as to allow the drive member 41 or 41A to open the sleeve 21 at any given point along the seam 42, the sleeve 21 returning to its sealing and supportive position, and the seam 42 closing, after the drive member 41 or 41A has passed that particular point. Thus it may be seen that the sleeve 21 allows for the efficient and quiet operation of the rod 14 or 14A by preventing the rod 14 or 14A from striking the channel member 1, by providing support for the rod 14 or 14A, and by sealing about the rod 14 or 14A thus preventing the threads 15 of the rod 14 or the slot 15A of the hollow rod 14A from being fouled. Furthermore, the sleeve 21 provides for all of the above advantages while being of sufficient flexibility to allow for the passage of the drive member 41 or 41A along the length of the rods 14 or 14A respectively.

Although preferred embodiments of the invention have been described, it will be readily apparent that alteration and modification may be resorted to without departing from the scope of the invention, and such alterations and modifications are intended to be included within the scope of the appended claims.

I claim:

1. A drapery track comprising:

a channel member;

a rod, said rod being located within said channel member;

operating means coupled with said rod whereby said operating means provides for the rotation of said rod;

a carriage, said carriage having a drive member engaging said rod, whereby rotation of said rod causes said carriage to traverse along said rod; and a resilient restraining sleeve located about said rod, said sleeve being positioned between said channel member and said rod, said sleeve providing said carriage drive member access to said rod, wherein said resilient sleeve is positioned annularly in a sealing relationship about said rod, said sleeve being provided with a lateral seam extending along the length of said restraining sleeve, said restraining sleeve seam allowing for said carriage drive member to pass through said sleeve, said sleeve being sufficiently resilient so as to maintain said annular sealing position as said carriage is traversed along said rod.

2. The drapery track claimed in claim 1 wherein said rod has said spiral thread located on the exterior surface of said rod.

3. The drapery track claimed in claim 2 wherein said carriage is moveably mounted to said channel member, and said carriage drive member extends annularly around a portion of said rod exterior circumference, the inner surface of said drive member, which forms said annular enclosure about said rod, being provided with a spiral grooved surface so as to engage said spiral threads on the exterior surface of said rod whereby said carriage may be driven along said rod by the rotation of said rod.

4. A drapery track comprising:

a channel member, wherein said channel member is further defined as having first and second parallel and adjacent channels, each of said channels being provided with a lip portion along the entire length of said channel, the lip of said first channel providing a surface upon which a plurality of truck means and said carriage may be moveably positioned, the second of said channels providing a housing for said rod and said rod restraining sleeve, said rod restraining sleeve being provided with a lip portion which is seated about the lip of said second channel;

a rod, said rod being located within said channel member;

operating means coupled with said rod wherein said operating means provides for the rotation of said rod;

a carriage, said carriage having a drive member engaging said rod, whereby rotation of said rod causes said carriage to traverse along said rod; and a resilient restraining sleeve located about said rod, said sleeve being positioned between said channel member and said rod, said sleeve providing said carriage drive member access to said rod.

5. The drapery track claimed in claim 7 wherein said first and second channels are each provided with two parallel lip portions along the length of said channels, and said truck means and said carriage are provided with roller means, each of said roller means being adapted to roll along said parallel lip channel portions of said first channel.

6. A drapery track comprising:

a channel member, a rod provided with a spiral thread, said rod being laterally positioned within said channel member;

operating means coupled with said rod whereby said operating means provides for the rotation of said rod;

a carriage moveably mounted to said channel member, said carriage having a drive member engaging said spiral threaded rod, whereby rotation of said rod by said operating means causes said carriage to traverse along said rod; and a resilient rod restraining sleeve located within said channel member and about said rod, said sleeve being positioned between said channel member and said rod thereby preventing said rod from contacting said channel member when said rod is rotated, said sleeve being positioned annularly in a sealing relationship about said rod, said sleeve being provided with a lateral seam extending the entire length of said sleeve, said sleeve seam allowing for said carriage drive member to pass through said sleeve annular enclosure, said sleeve being sufficiently resilient so as to maintain said annular sealing position as said carriage drive member is traversed along said rod.

7. A drapery track comprising:

a rod provided with a spiral thread;

a plurality of truck means;

operating means coupled with said rod whereby said operating means provides for the rotation of said rod, said operating means being further defined as a sprocket wheel assembly located adjacent at least one end of said rod, said sprocket wheels being provided with a plurality of spaced ribs located about the periphery of said sprocket wheels and adapted for engaging the balls of a ball chain;

a carriage, said carriage having a drive member with a spiral grooved surface in engagement with the spiral thread of said rod, whereby rotation of said rod causes said carriage to traverse along said rod;

a resilient restraining sleeve located within a channel member and about said rod, said sleeve being positioned between said channel member and said rod thereby preventing said rod from contacting said channel member when said rod is rotated, said sleeve being positioned annularly in a sealing relationship about said rod, said sleeve being provided with a lateral seam extending the entire length of said restraining sleeve, said sleeve seam allowing for said carriage drive member to open said seam adjacent said carriage drive member as said carriage drive member is traversed along said rod, said restraining sleeve being sufficiently resilient so as to return to said annular sealing position when no longer adjacent said carriage drive member; and said channel member having two parallel and adjacent channels, each of said channels being provided with inwardly extending lip portions along the entire length of said channels the lip portions of the first of said channels providing a surface upon which a plurality of said truck means and said carriage may be moveably positioned, the second of said channels providing a housing for said rod and said rod restraining sleeve, said rod restraining sleeve being provided with lip portions which are seated about the lip portions of said second channel, said sleeve seam being formed by said sleeve lip portions.

* * * * *